US010459373B2

(12) United States Patent
Tokuyama

(10) Patent No.: US 10,459,373 B2
(45) Date of Patent: Oct. 29, 2019

(54) TRANSFER DEVICE AND IMAGE FORMING APPARATUS

(71) Applicant: FUJI XEROX CO., LTD., Tokyo (JP)

(72) Inventor: Atsuhito Tokuyama, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 36 days.

(21) Appl. No.: 15/698,763

(22) Filed: Sep. 8, 2017

(65) Prior Publication Data

US 2018/0267436 A1 Sep. 20, 2018

(30) Foreign Application Priority Data

Mar. 17, 2017 (JP) ..... 2017-052799

(51) Int. Cl.
*G03G 21/16* (2006.01)
*G03G 15/16* (2006.01)
*G03G 15/00* (2006.01)

(52) U.S. Cl.
CPC ..... *G03G 15/1605* (2013.01); *G03G 15/1675* (2013.01); *G03G 15/657* (2013.01); *G03G 15/5004* (2013.01)

(58) Field of Classification Search
CPC ..... G03G 15/1605; G03G 15/1675; G03G 15/6576; G03G 15/657; G03G 2215/0129; G03G 2215/1661; G03G 2215/1623; G03G 2221/1672
See application file for complete search history.

(56) References Cited

U.S. PATENT DOCUMENTS

2010/0239335 A1* 9/2010 Sawai ..... G03G 15/161 399/319
2012/0275808 A1* 11/2012 Mochizuki ..... G03G 15/0189 399/66
2012/0282001 A1* 11/2012 Akashi ..... G03G 15/0131 399/308
2016/0187817 A1* 6/2016 Tokuyama ..... G03G 15/166 399/101

FOREIGN PATENT DOCUMENTS

JP 5476750 B2 4/2014
JP 5910362 B2 4/2016

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A transfer device includes a transfer member that transfers an image from an image carrier to a recording medium; a first member that is electrically connected to the transfer member; a downstream member that is located downstream of the transfer member in a direction in which the recording medium moves, that is electrically connected to the transfer member via the first member, and that transfers the recording medium to a second member that is located downstream of the downstream member and that is electrically insulated from the downstream member; and a first electric potential controller that, when the recording medium is changed to a recording medium having a higher bending strength, changes an electric potential of the downstream member to an electric potential that is higher than an electric potential of the downstream member before the recording medium is changed.

14 Claims, 4 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2017-052799 filed Mar. 17, 2017.

BACKGROUND

(i) Technical Field

The present invention relates to a transfer device and an image forming apparatus.

(ii) Related Art

In some existing technologies related to transfer devices, the electric potential of a transfer region and the electric potentials of members located adjacent to the transfer region are set at desired electric potentials.

However, as image forming apparatuses have been reduced in size in recent years, it is increasingly needed to strictly set the electric potentials of members adjacent to the transfer region. In particular, when a recording medium passes a downstream member that is electrically connected to a transfer member via a first member and that is insulated from a second member that is located downstream of the first member, a trouble such as peel-off failure or image blur may occur due to a change in environment or a change of recording medium.

SUMMARY

According to an aspect of the invention, a transfer device includes a transfer member that transfers an image, which has been formed on a surface of an image carrier and carried by the image carrier, from the image carrier to a recording medium that passes through a space between the transfer member and the image carrier when a voltage is applied between the transfer member and the image carrier; a first member that is electrically connected to the transfer member; a downstream member that is located downstream of the transfer member in a direction in which the recording medium moves, that is electrically connected to the transfer member via the first member, and that transfers the recording medium to a second member that is located downstream of the downstream member in the direction in which the recording medium moves and that is electrically insulated from the downstream member; and a first electric potential controller that, when the recording medium is changed to a recording medium having a bending strength higher than a bending strength of the recording medium before being changed, changes an electric potential of the downstream member to an electric potential that is higher than an electric potential of the downstream member before the recording medium is changed.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the invention will be described.

Figure 1:
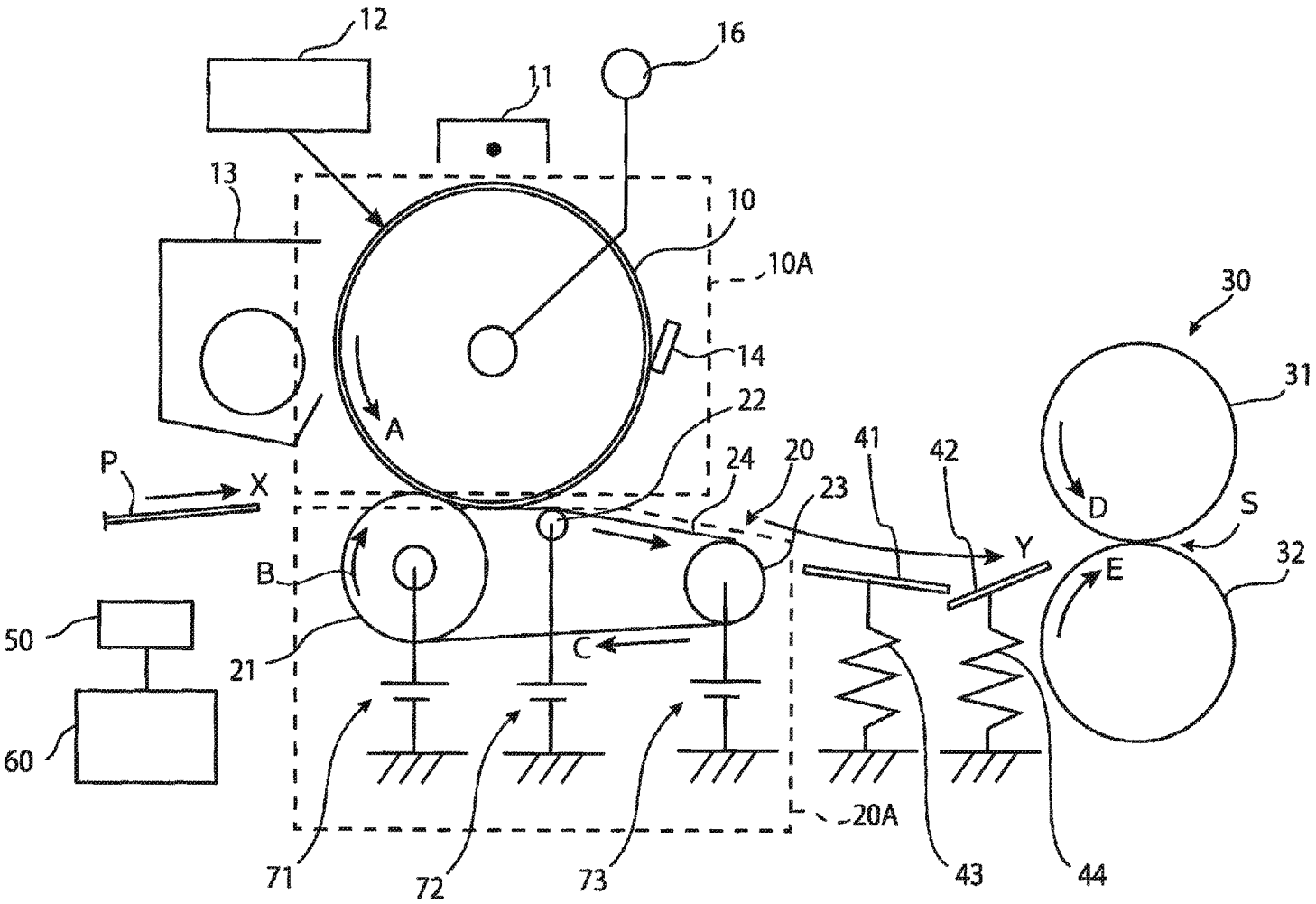
FIG. 1 is a schematic view of an image forming apparatus according to an exemplary embodiment of the present invention.

FIG. 1 is a schematic view of an image forming apparatus 1 according to an exemplary embodiment of the present invention.

The image forming apparatus 1 is a so-called direct-transfer monochrome printer.

The image forming apparatus 1 includes a photoconductor drum 10. The photoconductor drum 10 is rotatably supported by a drum support frame 10A and rotated by a photoconductor motor 16 in the direction of an arrow A. A charger 11, an exposure unit 12, and a developing unit 13 are arranged around the photoconductor drum 10. A toner image is formed on a surface of the photoconductor drum 10 through a charging process performed by the charger 11, an exposure process performed by the exposure unit 12, and a development process performed by the developing unit 13. The toner image is carried on the photoconductor drum 10. The exposure unit 12 exposes the photoconductor drum 10 to light in accordance with image data sent from the outside of the image forming apparatus 1, thereby forming a toner image represented by the image data on the photoconductor drum 10. To ensure the precision of exposure, the photoconductor drum 10 is rotated by the photoconductor motor 16 at a stable rotation speed. The photoconductor drum 10 corresponds to an example of an image carrier in the present invention.

A sheet transport mechanism (not shown) transports a sheet P (so-called "cut sheet"), which is an example of a recording medium, in the direction of an arrow X. The sheet P passes through a transfer region T between the photoconductor drum 10 and a transfer device 20 (described below). In the image forming apparatus 1 according to the present exemplary embodiment, information items about plural types of sheet P are registered. A user selects, by using an operation unit (not shown), one of the types of sheet P on which an image is to be formed. Examples of the information items about the types of sheet P that are registered include size, basis weight (thickness), and material. Some of the information items, such as basis weight, thickness, and material, represent the bending strength of the sheet P.

While the sheet P passes through the transfer region T, a toner image on the photoconductor drum 10 is transferred onto the sheet P. After the toner image has been transferred in the transfer region T, residual toner, which is toner that remains on the photoconductor drum 10, is removed from the photoconductor drum 10 by a cleaner 14.

The sheet P, to which the toner image has been transferred in the transfer region T, is transported further in the direction of an arrow Y, is guided by a first guide member and a second guide member, and is fed into a fixing unit 30. The fixing unit 30 includes a heating roller 31, which rotates in the direction of an arrow D; and a pressing roller 32, which rotates in the direction of an arrow E. The heating roller 31 and the pressing roller 32 are in contact with each other and form a fixing region S. The sheet P is transported in the direction of the arrow Y and enters the fixing region S. While the sheet P passes through the fixing region S, the sheet P is heated and pressed, so that the toner image on the sheet P is fixed to the sheet P. As a result, an image, which is a fixed toner image, is formed on the sheet P. The sheet P, on which the image has been formed, is discharged to the outside of the image forming apparatus 1 by a sheet output mechanism (not shown).

The image forming apparatus 1 further includes an environment sensor 50 that measures temperature and humidity in the apparatus, and a controller 60 that controls operations of various members of the image forming apparatus 1.

The transfer device 20, which corresponds to an exemplary embodiment of the present invention, includes a transfer roller 21, a press-contact roller 22, a peel-off roller 23, and a transfer belt 24. The transfer belt 24, which is an endless belt, is looped over the rollers 21, 22, and 23. The transfer roller 21, the press-contact roller 22, and the peel-off roller 23 are rotatably supported by a transfer-unit support frame 20A.

The transfer roller 21 is rotated by a motor (not shown) in the direction of an arrow B and drives the transfer belt 24. The transfer belt 24 is a resin belt having low elasticity and rotates in the direction of an arrow C by receiving a driving force from the transfer roller 21. The transfer roller 21 corresponds to an example of a transfer member in the present invention. The transfer belt 24 corresponds to an example of a first member in the present invention.

The transfer roller 21 is located upstream of the rotation axis of the photoconductor drum 10 in the sheet-transport direction. The transfer roller 21 presses the transfer belt 24 against the photoconductor drum 10 from the inside of the transfer belt 24. The transfer roller 21 defines an upstream edge of the transfer region T, which is a region where the photoconductor drum 10 and the transfer belt 24 are in contact with each other.

The press-contact roller 22 is located downstream of the rotation axis of the photoconductor drum 10 in the sheet-transport direction. The press-contact roller 22 presses the transfer belt 24 toward the photoconductor drum 10 from the inside of the transfer belt 24. The press-contact roller 22 defines a downstream edge of the transfer region T. The press-contact roller 22 corresponds to an example of an intermediate member in the present invention.

The peel-off roller 23 is a roller that is smaller in diameter than the transfer roller 21. The peel-off roller 23 sharply changes the direction in which the transfer belt 24 moves, thereby peeling a leading end of the sheet P, which is carried on the transfer belt 24, off the transfer belt 24. The sheet P, which has been peeled off the transfer belt 24, is guided by a first guide member 41 and a second guide member 42, which are made of metal; is transported in the direction of the arrow Y; and is fed into the fixing unit 30 as described above. The peel-off roller 23 is electrically connected to the transfer roller 21 via the transfer belt 24 and is electrically insulated from the first guide member 41. The peel-off roller 23 corresponds to an example of a downstream member in the present invention. The first guide member 41 and the second guide member 42 each correspond to an example of a second member in the present invention.

The transfer device 20 includes a cleaner 25. Toner and other wastes that have adhered to the transfer belt 24 are removed from the transfer belt 24 by the cleaner 25.

The transfer roller 21 is connected to a first power source 71. The first power source 71 applies an electric potential to the transfer roller 21, thereby applying a transfer bias voltage between the transfer roller 21 and the photoconductor drum 10. Due to the effect of the transfer bias voltage, a toner image on the photoconductor drum 10 is transferred onto the sheet P while the sheet P passes through the transfer region T. The controller 60 controls the electric potential of the transfer roller 21 as described below.

The press-contact roller 22 and the peel-off roller 23 are respectively connected to a second power source 72 and a third power source 73, and the controller 60 controls the electric potentials of the press-contact roller 22 and the peel-off roller 23 as described below.

The first guide member 41 and the second guide member 42 are grounded via resistors 43 and 44. The first guide member 41 and the second guide member 42 each have an electric potential that is naturally determined in accordance with the amount of charge of the sheet P and the like (that is, a natural-gradient electric potential).

In general, due to the difference between functions required for the transfer region T and the fixing region S, the potential difference between the transfer region T and the fixing region S is considerably large. On the other hand, regarding members disposed in a region extending from the transfer region T to the fixing region S, in general, it is desirable that the potential difference between the members is small. In order to satisfy these contradicting requirements, it is strongly needed that the electric potentials of the members disposed in the region extending from the transfer region T to the fixing region S be balanced.

In particular, as the image forming apparatus 1 has been reduced in size, the distance from the transfer region T to the fixing region S has become smaller. Therefore, strict balance between the electric potentials of the members is increasingly needed. Moreover, it is required that the image forming apparatus 1 be usable in a variety of environments, including a hot and wet environment and a cold and dry environment. Furthermore, it is required that the image forming apparatus 1 be capable of using a variety of sheets P, including a thick sheet and a thin sheet such as dictionary paper, and, in particular, capable of using sheets having different bending strengths. Such a change in the environment in which the image forming apparatus 1 is used and a change in sheet P has a strong effect on the balance of the electric potentials of the members.

To satisfy such requirements, in the present exemplary embodiment, the controller 60 performs electric potential control in accordance with the bending strength of the sheet P used for image formation and temperature and humidity measured by the environment sensor 50. The inventors carefully examined and found that, among members that are disposed in the region extending from the transfer region T to the fixing region S, control of the electric potential of the peel-off roller 23 is particularly effective. Electric potential control in accordance with the bending strength of the sheet P may be performed, for example, in accordance with the following properties of the sheet P, which are registered as sheet information items: basis weight, thickness, and material. A combination of the controller 60 and the third power source 73 corresponds to a first electric potential controller in the present invention and also corresponds to an example of a second electric potential controller in the present invention.

Hereinafter, specific examples of the electric potential control will be described.

Figure 2:
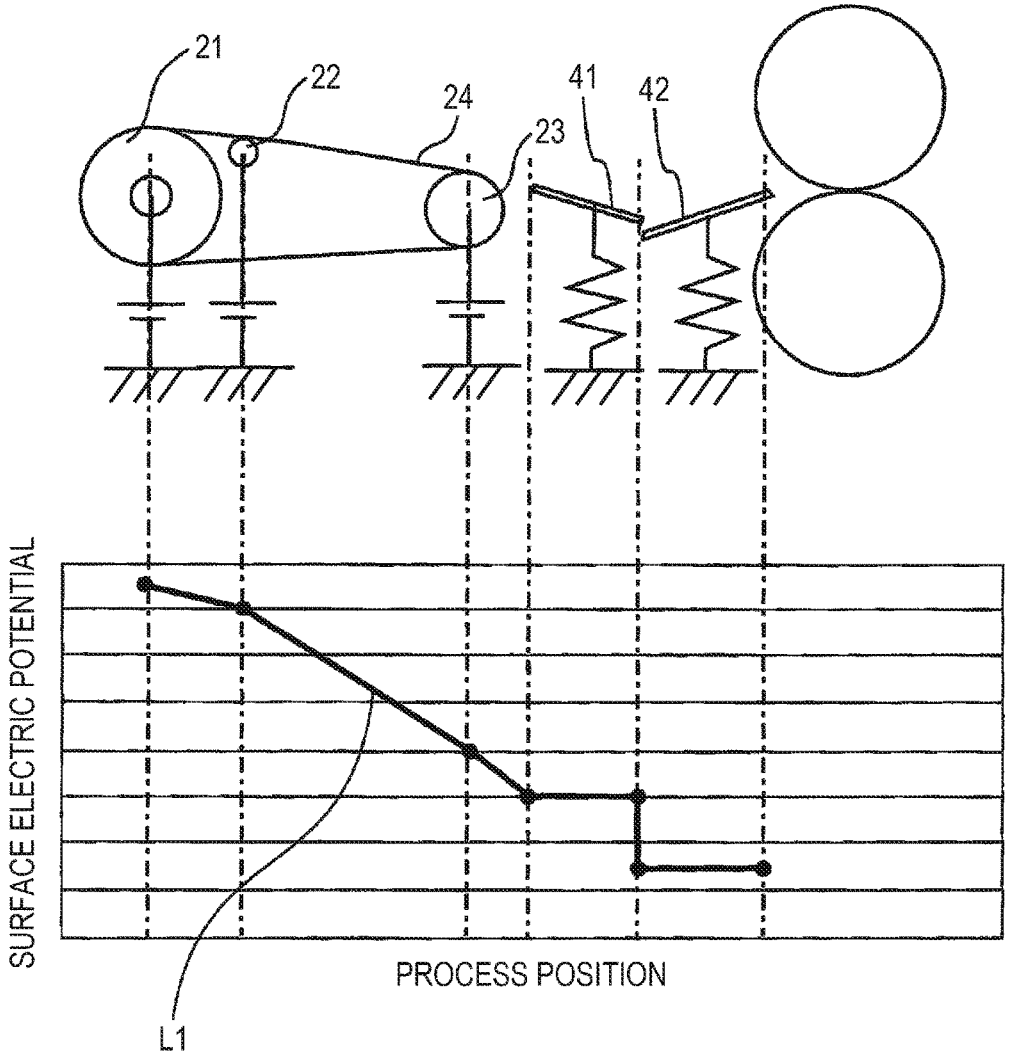
FIG. 2 illustrates electric potential control that is performed when a sheet having a low bending strength is used in a cold and dry environment.
Figure 3:
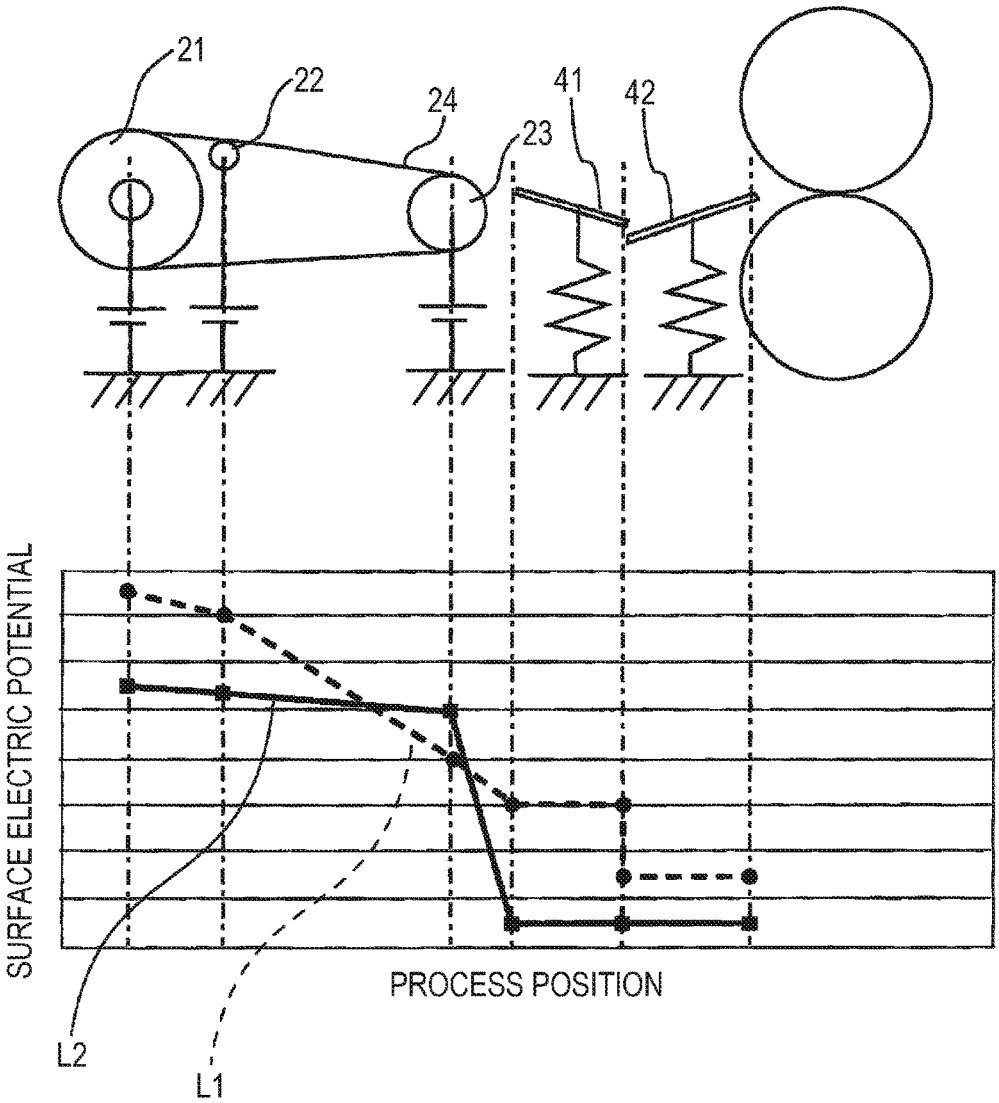
FIG. 3 illustrates electric potential control that is performed when a sheet having a medium or low bending strength is used in a hot and wet environment.
Figure 4:
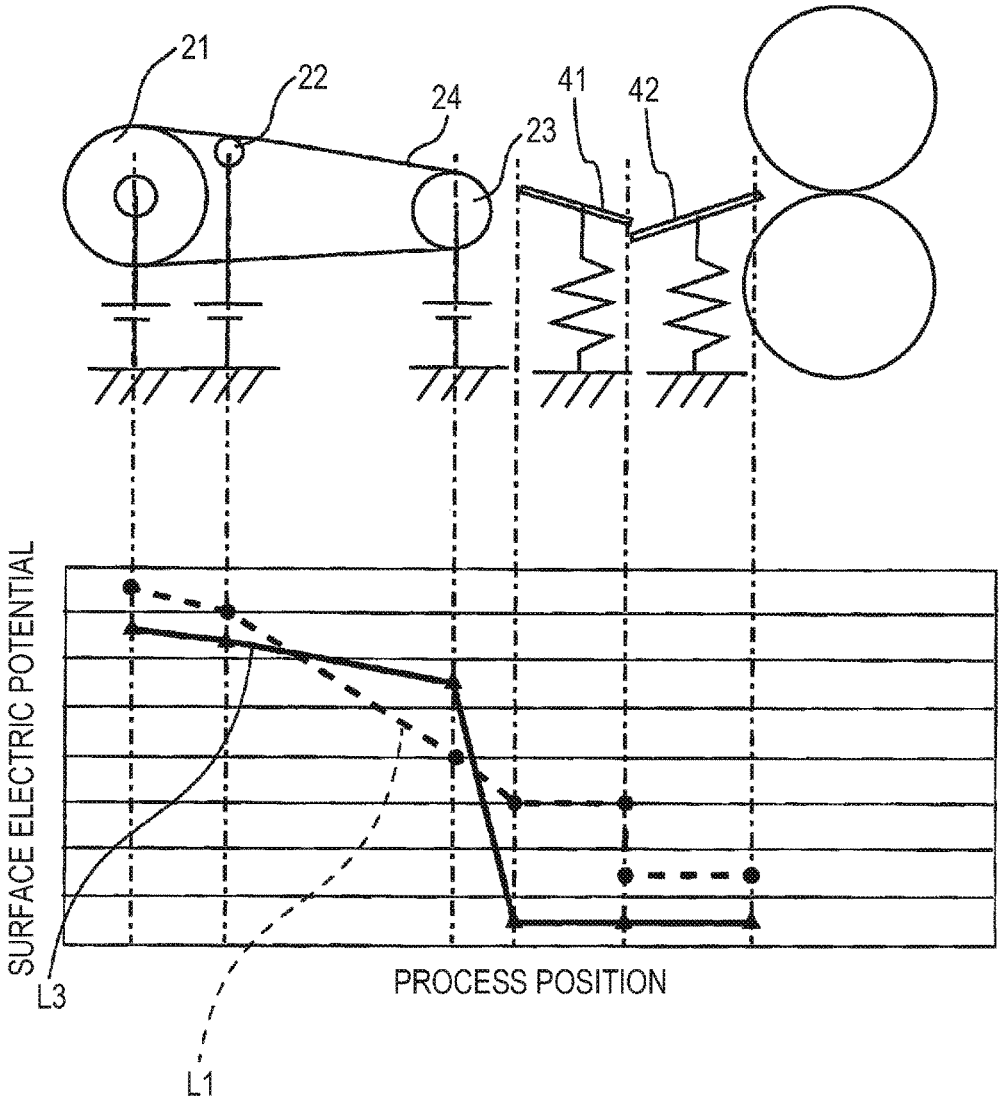
FIG. 4 illustrates electric potential control that is performed when a sheet having a high bending strength is used in a hot and wet environment.

FIGS. 2 to 4 illustrate specific examples of electric potential control. FIG. 2 illustrates electric potential control that is performed when a sheet P having a low bending strength is used in a cold and dry environment. FIG. 3 illustrates electric potential control that is performed when a sheet P having a medium or low bending strength is used in a hot and wet environment. FIG. 4 illustrates electric potential control that is performed when a sheet P having a high bending strength is used in a hot and wet environment.

The upper part of each of FIGS. 2 to 4 illustrates the arrangement of members along the transport path of the sheet P. The lower part of each of FIGS. 2 to 4 illustrates a graph of the electric potentials of the members corresponding to the positions of the members. In each of the graphs, the vertical axis represents the electric potentials of the members, and the horizontal axis represents the positions (process positions) of the members along the transport path.

As represented by a graph line L1 of FIG. 2, when a sheet P having a low bending strength is used in a cold and dry environment, electric potential control is performed so that the potential difference between the transfer roller 21 and the peel-off roller 23 is large and the potential difference between the peel-off roller 23 and the first guide member 41 is small. In general, a sheet P having a low bending strength is not easily peeled off the transfer belt 24 when the sheet P moves from the peel-off roller 23 to the first guide member 41. However, because the potential difference between the peel-off roller 23 and the first guide member 41 is small, the sheet P having a low bending strength is easily peeled off the transfer belt 24 and moves to the first guide member 41. In general, a sheet P having a low bending strength is thin, and an image on the surface the sheet P tends to become blurred due to electric discharge when the sheet P moves from the peel-off roller 23 to the first guide member 41. However, because the potential difference between the peel-off roller 23 and the first guide member 41 is small, such blur is suppressed. Moreover, the resistance of the transfer belt 24 is high in a cold and dry environment. Therefore, even through the potential difference between the transfer roller 21 and the peel-off roller 23 is large, an influence on the transfer bias voltage in the transfer region is small and image transfer is normally performed. In the present exemplary embodiment, the electric potential of the press-contact roller 22 is controlled to be higher than an electric potential that the press-contact roller 22 would have if the electric potential changed linearly from the transfer roller 21 to the peel-off roller 23. Therefore, the electric potential of a region on the transfer roller 21 side of the press-contact roller 22 is maintained at a high level so as to contribute to transfer of an image, and the electric potential of a region on the peel-off roller 23 side of the press-contact roller 22 sharply decreases so as to contribute to peeling-off of a sheet by the peel-off roller 23. By controlling the electric potential of the press-contact roller 22 in this way, contributions of the electric potentials on the transfer side and the peel-off side are differentiated from each other, thereby easily realizing appropriate control of electric potentials to both sides.

In FIG. 3, a graph line L1 (dotted line) is the same as that of FIG. 2, and a graph line L2 (solid line) represents electric potential control that is performed when a sheet P having a medium or low bending strength is used in a hot and wet environment.

Due to the hot and wet environment, the resistance of the transfer belt 24 is low and the potential difference between the transfer roller 21 and the peel-off roller 23 tends to have a strong effect on the transfer bias voltage in the transfer region. Therefore, the electric potential of the peel-off roller 23 is higher than an electric potential on the graph line L1 (dotted line), and the potential difference between the transfer roller 21 and the peel-off roller 23 is small.

On the other hand, due to the hot and wet environment, the electric potentials of the first guide member 41 and the second guide member 42 are lower than electric potentials on the graph line L1 (dotted line). Therefore, the potential difference between the peel-off roller 23 and the first guide member 41 is large. However, because electric discharge is unlikely to occur when the sheet P moves from the peel-off roller 23 to the first guide member 41 in a hot and wet environment, image blur described above is suppressed.

Thus, when the environment changes from a cold and dry environment to a hot and wet environment, the electric potential of the peel-off roller 23 is changed from a low electric potential to a high electric potential. Therefore, transfer of an image in the transfer region and peeling of the sheet P off the peel-off roller 23 are appropriately performed, and image blur, which may occur due to electric discharge when the sheet P moves from the peel-off roller 23 to the first guide member 41, is suppressed. Here, electric potential control that is performed when the environment changes from a cold and dry environment to a hot and wet environment has been described as an example. However, when the environment changes from a cold environment to a hot environment or from a dry environment to a wet environment, by performing electric potential control similar to the above, transfer of an image and peeling off of a sheet P are performed appropriately and image blur is suppressed.

In FIG. 4, a graph line L1 (dotted line) is the same as that of FIG. 2, and a graph line L3 (solid line) represents electric potential control that is performed when a sheet P having a high bending strength is used in a hot and wet environment.

In general, a sheet P having a high bending strength is thick and requires a high transfer bias voltage in the transfer region. Therefore, the electric potentials of the transfer roller 21, the press-contact roller 22, and the peel-off roller 23 are higher than those shown in FIG. 3.

The potential difference between the peel-off roller 23 and the first guide member 41 is larger than that shown in FIG. 3. However, because electric discharge is unlikely to occur in a hot and wet environment and because electric discharge is more unlikely to occur when a sheet P having a high bending strength (that is, having a large thickness) is used, image blur described above is suppressed.

Thus, when the sheet P is changed from a sheet P having a low bending strength (small thickness) to a sheet P having a high bending strength (large thickness), the electric potential of the peel-off roller 23 is changed from a low electric potential to a high electric potential. Therefore, transfer of an image in the transfer region and peeling of the sheet P off the peel-off roller 23 are appropriately performed, and image blur, which may occur due to electric discharge when the sheet P moves from the peel-off roller 23 to the first guide member 41, is suppressed.

In the above description, a monochrome printer is described as an exemplary embodiment of an image forming apparatus according to the present invention. However, an image forming apparatus according to the present invention may be a color printer, a copier, a facsimile, or a multifunctional machine.

In the above description, a direct-transfer apparatus is described as an exemplary embodiment of an image forming apparatus according to the present invention. However, an image forming apparatus according to the present invention may be an indirect-transfer apparatus that transfers an image from a photoconductor to a recording medium via an intermediate transfer member.

In the above description, an apparatus that performs electric potential control in accordance with both of a change in the bending strength of a sheet and a change in environment is described as an exemplary embodiment of the present invention. However, an apparatus according to the present invention may perform electric potential control in accordance with only one of a change in the bending strength of a sheet and a change in environment.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer member configured to transfer an image, which has been formed on a surface of an image carrier and carried by the image carrier, from the image carrier to a recording medium that passes through a space between the transfer member and the image carrier when a voltage is applied between the transfer member and the image carrier;

a first member that is electrically connected to the transfer member;

a downstream member that is located downstream of the transfer member in a direction in which the recording medium moves, that is electrically connected to the transfer member via the first member, and that transfers the recording medium to a second member that is located downstream of the downstream member in the direction in which the recording medium moves and that is electrically insulated from the downstream member; and a first electric potential controller that, when the recording medium is changed to a recording medium having a bending strength higher than a bending strength of the recording medium before being changed, is configured to change an electric potential of the downstream member to an electric potential that is higher than an electric potential of the downstream member before the recording medium is changed.

2. The transfer device according to claim 1, further comprising:

an intermediate member that is disposed between the transfer member and the downstream member and that has an electric potential higher than an electric potential that the intermediate member would have if a linear change from an electric potential of the transfer member to the electric potential of the downstream member is assumed.

3. The transfer device according to claim 1, wherein the downstream member is located downstream of a transfer region where the image is transferred to the recording medium.

4. The transfer device according to claim 1, wherein first member is a transfer belt that contacts the recording medium.

5. The transfer device according to claim 1, wherein the first member is an endless transfer belt and the downstream member is a roll that is located downstream of any roll inside of the first member in a direction in which the recording medium moves.

6. The transfer device according to claim 5, wherein the transfer member is rotated by a motor.

7. The transfer device according to claim 5, wherein the transfer member is rotated by a motor.

8. A transfer device comprising:

a transfer member configured to transfer an image, which has been formed on a surface of an image carrier and carried by the image carrier, from the image carrier to a recording medium that passes through a space between the transfer member and the image carrier when a voltage is applied between the transfer member and the image carrier;

a first member that is electrically connected to the transfer member;

a downstream member that is located downstream of the transfer member in a direction in which the recording medium moves, that is electrically connected to the transfer member via the first member, and that transfers the recording medium to a second member that is located downstream of the downstream member in the direction in which the recording medium moves and that is electrically insulated from the downstream member; and a second electric potential controller that, when an environment changes to at least one of a hotter environment and a wetter environment, is configured to change an electric potential of the downstream member to an electric potential that is higher than an electric potential of the downstream member before the environment changes.

9. The transfer device according to claim 8, further comprising:

an intermediate member that is disposed between the transfer member and the downstream member and that has an electric potential higher than an electric potential that the intermediate member would have if a linear change from an electric potential of the transfer member to the electric potential of the downstream member is assumed.

10. The transfer device according to claim 8, wherein the downstream member is located downstream of a transfer region where the image is transferred to the recording medium.

11. The transfer device according to claim 8, wherein first member is a transfer belt that contacts the recording medium.

12. An image forming apparatus comprising:

an image carrier on whose surface an image is formed and that carries the image;

a transfer member configured to transfer the image from the image carrier to a recording medium that passes through a space between the transfer member and the image carrier when a voltage is applied between the transfer member and the image carrier;

a first member that is electrically connected to the transfer member;

a downstream member that is located downstream of the transfer member in a direction in which the recording medium moves and that is electrically connected to the transfer member via the first member; and a second member that is located downstream of the downstream member in the direction in which the recording medium moves, that is electrically insulated from the downstream member, and that receives the recording medium from the downstream member; and an electric potential controller that, when the recording medium is changed to a recording medium having a bending strength higher than a bending strength of the recording medium before being changed, is configured to change an electric potential of the downstream member to an electric potential that is higher than an electric potential of the downstream member before the recording medium is changed.

13. The image forming apparatus according to claim 12, wherein the downstream member is located downstream of a transfer region where the image is transferred to the recording medium.

14. The image forming apparatus according to claim 12, wherein first member is a transfer belt that contacts the recording medium.

* * * * *